US005185015A

United States Patent [19]

Searle

[11] Patent Number: 5,185,015

[45] Date of Patent: Feb. 9, 1993

[54] FILTER APPARATUS

[76] Inventor: Bruce R. Searle, 7814 Amity Rd., Amity, Oreg. 97101-2410

[21] Appl. No.: 671,127

[22] Filed: Mar. 18, 1991

[51] Int. Cl.[5] ..... B03C 3/38

[52] U.S. Cl. ..... 55/102; 55/124; 55/279; 55/524; 422/121

[58] Field of Search ..... 55/102, 6, 124, 524, 55/279; 422/24, 121

[56] References Cited

U.S. PATENT DOCUMENTS

| | | | |
|---|---|---|---|
| 3,237,382 | 3/1966 | Berly | 55/279 X |
| 3,576,593 | 4/1971 | Cicirello | 55/279 X |
| 3,716,966 | 2/1973 | De Seversky | 55/129 X |
| 3,722,182 | 3/1973 | Gilbertson | 55/124 |
| 3,745,750 | 7/1973 | Arff | 55/124 X |
| 3,988,131 | 10/1976 | Kanazawa et al. | 55/124 X |
| 4,244,712 | 1/1981 | Tongret | 55/124 |
| 4,981,501 | 1/1991 | Von Blucher et al. | 55/524 X |

FOREIGN PATENT DOCUMENTS

| | | | |
|---|---|---|---|
| 1029116 | 1/1953 | France | 55/124 |

OTHER PUBLICATIONS

Hawley, G. G.; *The Condensed Chemical Dictionary;* Eighth Edition; Reinhold Company, p. 591; 1971.

*Primary Examiner*—Richard L. Chiesa

*Attorney, Agent, or Firm*—Dellett, Smith-Hill and Bedell

[57] ABSTRACT

Filter apparatus for removing contaminants from air includes a housing having an inlet opening and an outlet opening, and a fan for maintaining a flow of air through the housing from the inlet opening to the outlet opening. A first filter element removes particles greater than a predetermined size from air entering the housing by way of the inlet opening, and a second filter element removes particles of selected chemical species from air that has passed through the first filter element in the direction from the inlet opening to the outlet opening. The second filter element defines a chamber that is in open communication with the outlet opening, and the chamber constitutes a third filter element in which air is irradiated with ultraviolet light.

1 Claim, 1 Drawing Sheet

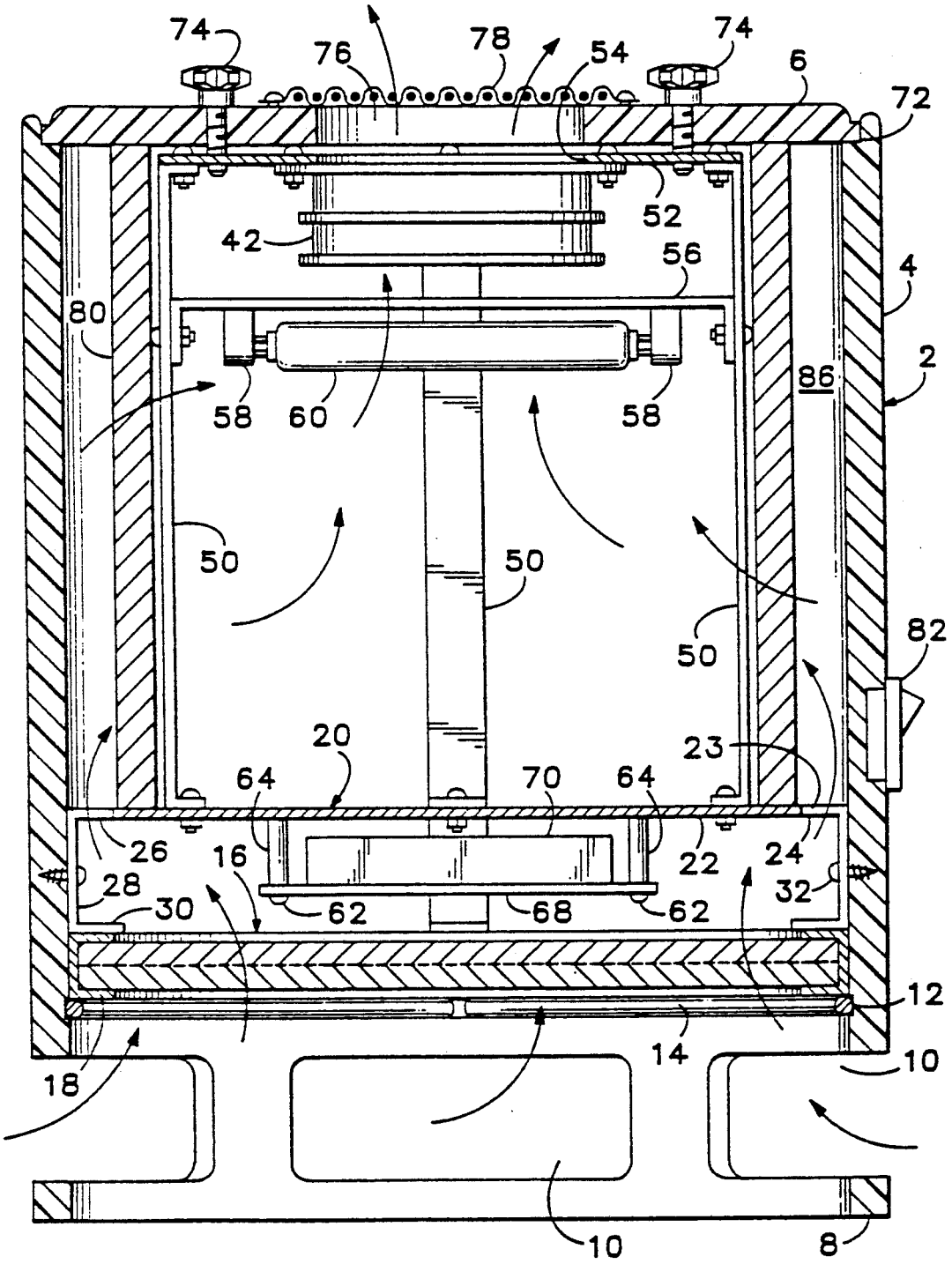
74
76
78
54
74
6
72
52
42
56
4
80
2
86
58
60
58
50
50
50
82
20
23
64
70
64
26
16
22
24
28
30
62
68
62
32
12
14
10
18
10
8

FILTER APPARATUS

BACKGROUND OF THE INVENTION

This invention relates to filter apparatus for removing contaminants from air.

The contaminants that are present in normal room air include dust particles, pollens, bacteria, viruses and various odoriferous molecules. It is frequently desirable to remove dust particles and pollens from the air in a particular room, for example because the occupant of the room is allergic to one or more of the contaminants. Furthermore, in a hospital operating room or a dentist's office, it is desirable to remove bacteria and viruses in order to prevent the spread of infection. Removal of odoriferous contaminants, such as hydrogen sulfide and sulfur dioxide, is desirable in order to make occupation of the room more pleasant.

It is known to use various types of mechanical and absorbent filter elements in portable fan-driven filters for removing contaminants from the air in a room. In particular, such filters are used to remove airborne dust.

It is also known to use ultraviolet light to kill airborne bacteria. For example, an ultraviolet bulb may be mounted in an air conditioning duct so that all the air that passes through the duct is irradiated. This is a form of filtration, since the bacteria's capacity to reproduce is removed. A disadvantage of this arrangement is that measures must be taken to remove dust from the air before it reaches the ultraviolet bulb, because otherwise dust is deposited on the bulb and impairs its efficiency. It is possible to use an electrostatic filter to extract dust particles from the air, but such filters are very expensive. Another expensive alternative is to use a HEPA (high efficiency particle arrestance) filter, but such a filter would have a relatively short useful life because of the large volume of air passing through the filter.

Molecular sieves can be used to remove certain species of molecules from the air. A typical molecular sieve is made from crystalline zeolite material and operates by adsorbing molecules that are smaller than a limit that depends on the crystal structure of the sieve material.

SUMMARY OF THE INVENTION

In accordance with the present invention, filter apparatus for removing contaminants from air comprises a housing having an inlet opening and an outlet opening, impeller means for maintaining a flow of air through the housing from the inlet opening to the outlet opening, first filter means for removing particles greater than a predetermined size from air entering the housing by way of the inlet opening, second filter means for removing particles of selected chemical species from air that has passed through the first filter means in the direction from the inlet opening to the outlet opening, the second filter means defining a chamber that is in open communication with the outlet opening, and third filter means for irradiating air in the chamber with ultraviolet light.

BRIEF DESCRIPTION OF THE DRAWING

For a better understanding of the invention, and to show how the same may be carried into effect, reference will now be made, by way of example, to the accompanying drawing, the single FIGURE of which is a vertical sectional view of an air filter embodying the present invention.

DETAILED DESCRIPTION OF THE PREFERRED EMBODIMENT

The illustrated filter apparatus comprises a filter housing 2 that bounds a generally cylindrical filter chamber. The filter housing comprises a peripheral wall 4 and a cover 6. The wall 4 is annular in horizontal section and has a bottom surface 8 that, in use, rests on a horizontal support surface, such as the floor of a room. Slightly above the annular bottom surface 8, the housing wall 4 is formed with air inlet openings 10. By way of example, the housing wall may be formed with four air inlet openings, each of which has an angular extent around the central axis of the cylindrical housing of about 80° degrees.

Immediately above the inlet openings 10 is an annular groove 12, which receives a metal spring retaining ring 14. An electrostatic filter 16, having a peripheral frame 18, rests on the retainer ring. The filter 16 comprises upper and lower retainer webs of polypropylene net having a mesh size of at least 0.63 cm, an intermediate web of non-woven polyester fabric, and two filter pads retained between the intermediate web and the upper and lower webs respectively. The filter pads are made of polypropylene filaments. When air passes through the filter 16, friction between the air and the polypropylene filaments generates a strong electrostatic charge that attracts and retains airborne particles. In this fashion, the air passing through the filter 16 undergoes two stages of electrostatic prefiltering, in the two filter pads respectively. The polypropylene filaments are impregnated with a pigment that absorbs ultraviolet light. Suitable filter pads are obtainable from Permatron of Franklin Park, Ill. This type of electrostatic filter structure is commonly employed in computer installations and clean rooms.

A drum filter support is located above the electrostatic filter. The drum filter support comprises a lower plate 20 having a circular central area 22 whose radius is somewhat less than the internal radius of the housing wall 4, so that a space 23 is defined between the periphery of the central area 22 and the internal surface of the housing wall, and four arms 24, only three of which can be seen in the drawing, projecting radially from the central area 22. Each arm has an upper horizontal portion 26, a vertical portion 28 that extends downward, and a lower horizontal portion 30 that extends radially inward. The plate 20 is attached to the housing wall by screws 32 that extend through the vertical portions 28 of the arms 24. The lower horizontal portion 30 of each arm 24 is spaced from the annular groove 12 by a distance that is slightly greater than the thickness of the peripheral frame 18 of the filter 16, and accordingly the filter 16 is captive between the retainer ring and the drum filter support.

Four C-shaped vertical brackets 50, only three of which can be seen in the drawing, are attached to the plate 20 and extend upwards within the filter chamber. The vertical brackets 50 are attached at their upper ends to an annular plate 52 defining a circular opening 54. A conventional pancake fan 42 is attached to plate 52 beneath the opening 54. Two of the brackets 50 are connected together by a horizontal support bracket 56, which extends generally diametrically across the housing wall 4 and is provided with sockets 58 spaced apart therealong for receiving opposite ends of an ultraviolet bulb 60. Screws 62 and spacers 64 are used to connect a plate 68 to the underside of plate 20 in spaced parallel relationship. The plate 68 carries on its upper side a package 70 containing a ballast circuit that is connected to the sockets 58 and a fan control circuit that is connected to the fan 42.

The cover 6 is circular and is sized to fit in an annular rabbet 72 formed at the top of housing wall 4. The cover 6 is attached to the secondary filter support by means of screws 74 that engage plate 52. The cover 6 is formed with a circular outlet opening 76 that is disposed vertically above the opening 54 in plate 52. A mesh fan guard 78 is attached to the cover 6 to prevent small objects from being inserted into the fan.

A drum filter 80 is seated on the plate 20 and engages the underside of the cover 6. The drum filter 80, which defines a cylindrical irradiation chamber containing fan 42, brackets 50 and bulb 60, comprises three porous filter membranes impregnated with adsorbents for removing odoriferous gases from air passing through the drum filter. A suitable filter membrane material is an open cell foam made of non-woven polyester. The inner and outer memberanes are impregnated with activated charcoal, which removes many hydrocarbon gases, including acetylene. A suitable form of activated charcoal is sold under the designation POLYSORB by Columbus Industries of Ashville, Ohio. However, activated charcoal is not effective on certain species of molecules, particularly certain inorganic molecules and small molecules. The intermediate membrane is impregnated with synthetic zeolite, which removes molecular species such as nitrogen oxides, $SO_2$, $NH_3$ and $H_2S$. A suitable synthetic zeolite is sold under the designation AMN/WR by Permatron of Franklin Park, Ill. This construction of the drum filter ensures that the air is exposed to activated charcoal before it reaches the synthetic zeolite, and also allows the total quantity of activated charcoal to be substantially greater than the total quantity of zeolite.

The fan control circuit and the ballast circuit are connected by wiring (not shown) to a control switch 82 for controlling supply of operating current to the fan control circuit and the ballast circuit. The rocker of the control switch includes an indicator light to indicate whether operating current is being provided.

When the filter apparatus is connected to a source of operating current and the switch 82 is on, operating current is supplied by the ballast circuit to the ultraviolet bulb, which emits ultraviolet light, and by the fan control circuit to the fan, which draws a flow of air into the housing through the inlet openings 10, through the electrostatic filter 16, the drum filter 80 and the irradiation chamber, and exhausts it through the outlet opening 38 and the grill 46.

The electrostatic filter 16 removes 98 percent of particles greater than 0.1 μm in diameter from normal room air. The prefiltered air passes into the annular space 86 between the housing wall 4 and the drum filter 80 and passes through the drum filter. The activated charcoal and synthetic zeolite remove odoriferous gases from the air. In the irradiation chamber, air is exposed to ultraviolet radiation from the ultraviolet bulb 60. The effect of this ultraviolet radiation is to kill bacteria, viruses, mold and mildew and thereby remove the capacity of these organisms to reproduce. In order to ensure that ozone is not generated in the irradiation chamber, the bulb is selected to emit light at wavelengths in the range from 253 nm to 257 nm. A suitable bulb can be obtained from Atlantic Ultraviolet of Bay Shore, N.Y.

From time to time it is necessary to replace the drum filter. This is accomplished by removing the screws 74 that are used to hold the cover 6 in position. The drum filter 80 can then be removed and replaced, and the cover 6 attached again to the plate 52.

The electrostatic filter 16 does not need to be replaced, but it needs to be cleaned from time to time. This is accomplished by lifting the filter apparatus up and removing the retainer ring 14 from its groove 12. The electrostatic filter can then be withdrawn from the housing through the bottom opening and cleaned, for example by use of a vacuum cleaner or by rinsing with water.

It will therefore be seen that the illustrated filter apparatus provides multi-stage filtration of air. The electrostatic filter removes most airborne particles, the drum filter removes certain objectionable gases, and the irradiation filter removes undesirable characteristics of certain airborne agents.

It will be appreciated that the invention is not restricted to the particular embodiment that has been described, and that variations may be made therein without departing from the scope of the invention as defined in the appended claims and equivalents thereof. For example, the drum filter may be constructed of only two porous filter membranes, the inner membrane being impregnated with zeolite and the outer membrane being thicker than the inner membrane and being impregnated with activated charcoal. In this fashion, an appropriate balance between the quantities of activated charcoal and zeolite can be achieved without having to use three porous membranes.

I claim:

1. Filter apparatus for removing contaminants from air, comprising:

a housing wall that is generally annular in section and has first and second opposite ends, said housing wall bounding a filter chamber and being formed with an inlet opening at said first end thereof, a cover attached to the housing wall at said second end thereof and formed with an outlet opening, impeller means for maintaining a flow of air through the filter chamber from the inlet opening to the outlet opening, a generally circular porous filter pad located inside the filter chamber so that air flowing along the axis of the housing wall from said one end of the housing wall to said opposite end thereof passes through the filter pad, whereby particles greater than a predetermined size are removed from air entering the filter chamber by way of the inlet opening, the filter pad being made of electrically insulating material such that when air passes through the pad, friction between the air and the insulating material generates a strong electrostatic charge that attracts and retains airborne particles, a drum filter support plate mounted in the filter chamber between the porous filter pad and the cover, a drum filter mounted in the filter chamber coaxially therewith and engaging the cover and the drum filter support plate, an annular space being defined between the drum filter and the internal surface of the housing wall and the drum filter defining a second chamber that is in communication with the outlet opening so that air flowing from the inlet opening to the outlet opening passes through the porous filter pad to said annular space and passes from said annular space to said second chamber through the drum filter, the drum filter comprising first, second and third porous webs through which air flowing from the inlet opening to the outlet opening passes sequentially, the first and third webs being impregnated with activated charcoal and the second web being impregnated with molecular sieve material, whereby the drum filter removes selected molecular species from air that has passed through the porous filter pad in the direction from the inlet opening to the outlet opening, a lamp located in said second chamber, said lamp, when energized, emitting light at a wavelength within the range from about 253 nm to about 257 nm, whereby air in said second chamber is irradiated with ultraviolet light, and a power supply circuit for energizing the lamp.

* * * * *